US005199978A

United States Patent [19]

Poirier et al.

[11] Patent Number: 5,199,978

[45] Date of Patent: Apr. 6, 1993

[54] PROCESS FOR REMOVING ELEMENTAL SULFUR FROM FLUIDS

[75] Inventors: Marc A. Poirier, Sarnia; Robert J. Falkiner, Mississauga; Daniel W. Kraemer, Clearwater; John B. Gilbert; Ian D. Campbell, both of Sarnia, all of Canada

[73] Assignee: Exxon Research and Engineering Company, Florham Park, N.J.

[21] Appl. No.: 715,959

[22] Filed: Jun. 17, 1991

[51] Int. Cl.[5] ..... C10G 19/00

[52] U.S. Cl. ..... 208/233; 208/236; 210/728

[58] Field of Search ..... 208/233, 236; 210/728

[56] References Cited

U.S. PATENT DOCUMENTS

| | | | |
|---|---|---|---|
| 1,968,842 | 8/1934 | Malisoff | 208/236 |
| 2,084,575 | 6/1937 | Day, Jr. | 208/233 |
| 2,585,284 | 2/1952 | Tom et al. | 208/233 |
| 2,693,442 | 11/1954 | Tom et al. | 208/233 |
| 2,999,803 | 9/1961 | Duval, Jr. | 208/233 |

FOREIGN PATENT DOCUMENTS

| | | | |
|---|---|---|---|
| 238268 | 4/1960 | Australia | 208/233 |
| 1525195 | 11/1989 | U.S.S.R. | 208/236 |
| 879731 | 10/1961 | United Kingdom | 208/233 |

*Primary Examiner*—David Brunsman
*Attorney, Agent, or Firm*—Roy J. Ott

[57] ABSTRACT

The present invention provides a process for removing elemental sulfur from fluids such as refined petroleum products transported through pipelines for the transportation of sour hydrocarbon streams. The sulfur-containing fluids are mixed with an inorganic caustic material, an alkyl alcohol and an organo mercaptan or sulfide compound capable of reacting with sulfur to form a fluid-insoluble polysulfide salt reaction product at ambient reaction temperatures. The treated fluid is then contacted with an adsorbent or filtered to remove the insoluble salt leaving a product of very low residual sulfur content.

10 Claims, 1 Drawing Sheet

PROCESS FOR REMOVING ELEMENTAL SULFUR FROM FLUIDS

BACKGROUND OF THE INVENTION

1. Field of the Invention

This invention relates to a process for removing elemental sulfur from fluids, particularly fuels such as gasoline transported in a pipeline for the transportation of sour hydrocarbon streams. The fluids are contacted with an inorganic caustic material, alcohol and mercaptan or sulfide to convert the sulfur to insoluble polysulfides which are removed from the fluid.

2. Description of Related Art

It is well known that elemental sulfur and other sulfur compounds contained in hydrocarbon streams is corrosive and damaging to metal equipment, particularly copper and copper alloys. Sulfur and sulfur compounds may be present in varying concentrations in the refined fuels and additional contamination may take place as a consequence of transporting the refined fuel through pipelines containing sulfur contaminants resulting from the transportation of sour hydrocarbon streams such as petroleum crudes. The sulfur has a particularly corrosive effect on equipment such as brass valves, gauges and in-tank fuel pump copper commutators.

Various techniques have been reported for removing elemental sulfur from petroleum products. For example U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

SUMMARY OF THE INVENTION

The present invention provides a process for removing elemental sulfur from fluids such as hydrocarbon fuels, fuel blending components such as octane improvers, liquefied petroleum gas (LPG), solvents and other petroleum streams transported in a pipeline for the transportation of sour hydrocarbon streams, comprising contacting the sulfur-containing fluid with an inorganic caustic material, an alcohol and an organo mercaptan compound capable of reacting with sulfur to form an insoluble polysulfide reaction product at ambient reaction temperatures. The treated fluid is then contacted with an absorbent and/or filtered to remove the insoluble polysulfides leaving a product of very low residual elemental sulfur content.

DETAILED DESCRIPTION OF THE INVENTION

Figure 1:
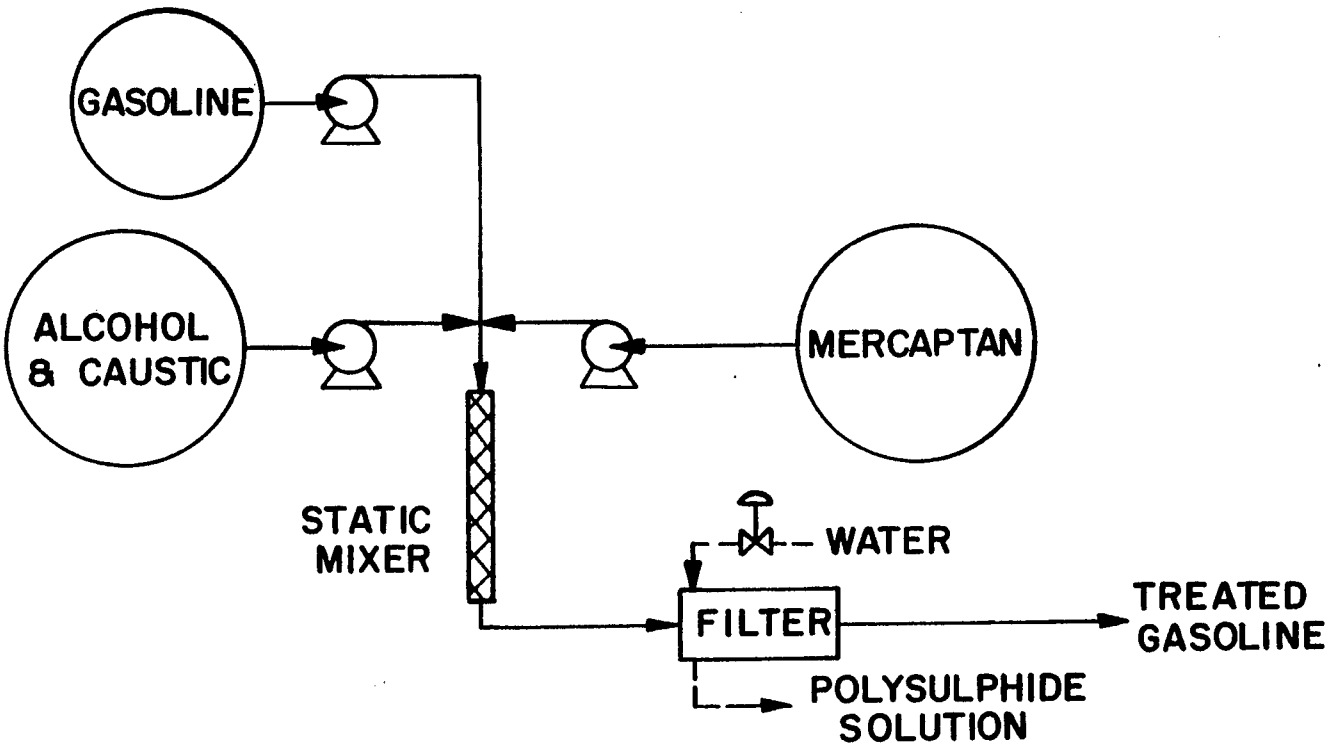
FIG. 1 is a schematic flow diagram illustrating the process sequence of the present invention as applied to gasoline.

The organo mercaptans useful in the present invention include a wide variety of compounds having the general formula RSH, where R represents an organic radical which may be alkyl, alkenyl, cycloalkyl, cycloalkenyl, aryl of arylalkyl having from 1 to about 16 carbon atoms. Thus, the radical may be, for example methyl, ethyl, n-propyl, i-propyl, n-butyl, i-butyl, sec-butyl, t-butyl, amyl, n-octyl, decyl, dodecyl, octadecyl, phenyl, benzyl and the like. Most preferably, RSH is an alkyl mercaptan containing 2 to 5 carbon atoms.

In another embodiment of the invention, the mercaptan may be combined with or replaced by a sulfide such as $K_2S$, $Na_2S$, NaHS, $Li_2S$, $H_2S$ and the like.

The inorganic caustic material which is employed in this invention includes alkali metal or ammonium hydroxides having the formula MOH wherein M is selected from the group consisting of lithium, sodium, potassium, $NH_4$, or mixtures thereof. M is most preferably sodium or potassium. As a result of the use of the inorganic caustic material, the resultant sulfur products are insoluble in the treated fluids and may be removed by the use of adsorbents and/or filtration.

Alcohols are employed in the invention as a phase transfer or solubilizing agent. Accordingly, a number of alcohols may be used for this purpose. Alcohols which may be used include, among others, $C_1$ to $C_{10}$ monoalcohols, more preferably $C_1$ to $C_4$ monoalcohols in which the other reagents are soluble. Other alcohols, polyols, glycols, polyglycols, glycol ethers and related materials capable of solvating the caustic for the purpose of effecting the reactions may also be used. Examples of preferred alcohols include methanol, ethanol, n-propanol, i-propanol, n-butanol, i-butanol and t-butanol.

The fluids which are treated in accordance with the invention include fluids containing elemental sulfur where the elemental sulfur is detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may also be treated in accordance with the invention.

In general, the process of the invention involves the addition to the fluid to be treated of effective amounts of one or a mixture of RSH organo mercaptan compounds, the alcohol and the caustic material as defined above to allow for the in-situ formation of a fuel-insoluble polysulfide salt. Most preferably, the caustic material is added to the fluid as a solution in the alcohol, and the organo mercaptan is added separately.

The treating conditions which may be used to carry out the present invention are conventional. Contacting of the fluid to be treated is effected at ambient temperature conditions, although higher temperatures up to 100° C. or higher may be employed. Substantially atmospheric pressures are suitable, although pressures may, for example, range up to 1000 psig. Contact times may vary widely depending on the fluid to be treated, the amount of elemental sulfur therein and the treating materials used. The contact time will be chosen to effect the desired degree of elemental sulfur removal. In most cases, the reaction proceeds relatively fast, usually within a few minutes. Contact times ranging from 30 seconds to a few hours will usually be adequate.

The reactants may be dispersed within the fluid to be treated using any suitable mixing device which will provide maximum mixing with the fluid. The process is particularly adapted for continuous operation wherein a static mixer is employed and the reactants are injected into a moving flow of the fluid prior to entry into the static mixer. Residence time in the mixer should be sufficient to maximize the formation of fluid insoluble sulfur/mercaptan polysulfide reaction product.

The amount of caustic used in accordance with the invention may range within wide limits, for example, from about 0.1 to 10.0 moles, preferably from about 0.5 to 2.0 moles, of caustic (MOH) per mole of elemental sulfur present in the fluid to be treated.

The amount of organo mercaptan and/or sulfide used in accordance with the invention generally ranges from 0.1 to about 2.0 moles, preferably from about 0.5 to 0.7 moles, of organo mercaptan and/or sulfide per mole of elemental sulfur present in the fluid to be treated.

As mentioned, the alcohol serves as solubilizing agent. The amount of alcohol present may therefore vary within wide limits. Typically, the amount of alcohol will range from about 100 to about 2500 volume parts per million (vppm) of the fluid being treated.

Fluids containing quantities of elemental sulfur as high as 100 mg, or higher, sulfur per liter, more usually from about 10 to about 60 mg per liter, can be effectively treated in accordance with this invention to reduce the elemental sulfur contamination to about 5 mg sulfur per liter or lower.

The insolubilized sulfur reaction products form a precipitate in the treated fluid. The reaction product may range from a floculant precipitate to a liquid dispersion, i.e., the polysulfide product may exist as finely dispersed solid particles coated with a liquid film. This precipitate may be separated from the fluid by any suitable process such as by contact with an absorbent or by filtration or coalescing. Suitable adsorbents include any material having adsorbent properties such as clay or clay like materials and particularly the highly adsorptive clays such as attapulgus clay, bauxite, fullers earth including Floridin and any hydrous aluminum silicate having the characteristics of the highly adsorptive clays such as Bentonite. Adsorptive carbon, chemically prepared silica or other adsorptive earthy materials may also be suitably employed.

Filter medium includes any material used commercially such as pleated paper, cellulose, nylon, or polyester or a packed bed of the adsorbent clays recited above.

Thus, in a preferred process as schematically illustrated in FIG. 1, a gasoline flow is pumped through a pipeline into a static mixer. Just before the static mixer inlet, a solution of caustic material in alcohol and the mercaptan are injected into the gasoline flow. Mixing occurs in the static mixer to ensure mixing of the reagents with the gasoline and to allow the reaction to take place with the formation of a polysulfide salts precipitate. The latter is then filtered from the gasoline using a cartridge filter to remove suspended solids. The filter cake may periodically be washed with water or water-/alcohol to dissolve the filter cake and regenerate the filter medium. Other methods such as water injection to dissolve the precipitate followed by electrostatic coalescing of the water from the fluid may also be used.

The following examples are illustrative of the invention.

EXAMPLES 1-7

Gasoline containing 38 mg/L of elemental sulfur (Mercury Number Method; UOP Method 286-59) was pumped at a rate of 25 ml/minute to the inlet of a ¼"diameter by 7" long static mixer. Just before the inlet, a solution containing NaOH dissolved in ethanol and n-propyl mercaptan (PrSH) was injected through a syringe pump. The concentrations and flow rates of the reagents were varied as described in Table 1. The molar amounts of NaOH and PrSH based on the elemental sulfur in the gasoline were varied from S:NaOH:PrSH —1:1:1 to 1:0.25:0. The amount of ethanol used ranged from 1200 to 2500 vppm based on the gasoline volume. The resulting stream was then passed through a static mixer and then to a filter where the precipitate was removed.

The examples in Table 1 show that PrSH addition is necessary to achieve essentially complete removal of sulfur. The caustic/alcohol solution by itself only reduces elemental sulfur to 20 mg/L. In the presence of n-propyl mercaptan, the elemental sulfur levels in the treated gasoline was less than 3 mg/L in Examples 1, 3, 5 and 6.

EXAMPLES 8-10

The gasoline of the prior examples was pumped at a rate of 50 and 100 ml/minute to the inlet of the aforedescribed static mixer. Just before the inlet, a solution containing KOH dissolved in ethanol was injected through a syringe pump and a solution containing $Li_2S$ dissolved in ethanol was injected through a second syringe pump. The concentrations, molar ratios and flow rates are shown below in Table 2. It is seen that addition of caustic and sulfide is effective for reducing the elemental sulfur level of the gasoline.

TABLE 1

| Ex | Reagents | Flowrate (mL/min) | S:Na:SH (molar) | Avg. Product S (mg/L) |
|---|---|---|---|---|
| 1 | 0.5 N NaOH/EtOH + 4.5 v % PrSH | 0.06 (2292 vppm EtOH) | 1:1:1 | 0.1 |
| 2 | 0.13 N NaOH/EtOH + 4.5 v % PrSH | 0.06 (2292 vppm | 1:0.25:1 | 18 |

TABLE 1-continued

| Ex | Reagents | Flowrate (mL/min) | S:Na:SH (molar) | Avg. Product S (mg/L) |
|---|---|---|---|---|
| | | EtOH) | | |
| 3 | 0.3 N NaOH/EtOH + 4.5 v % PrSH | 0.06 (2292 vppm EtOH) | 1:0.58:1 | 0.5 |
| 4 | 0.21 N NaOH/EtOH + 4.5 v % PrSH | 0.06 (2292 vppm EtOH) | 1:0.42:1 | 6 |
| 5 | 0.25 N NaOH/EtOH + 2.25 v % PrSH | 0.06 (2348 vppm EtOH) | 1:0.5:0.5 | 2 |
| 6 | 0.5 N NaOH/EtOH + 4.5 v % PrSH | 0.03 (1148 vppm EtOH) | 1:0.5:0.5 | 2 |
| 7 | 0.5 N NaOH/EtOH (no mercaptan) | 0.06 (2400 vppm EtOH) | 1:1:0 | 20 |

TABLE 2

| Syringe 1 1.8 N KOH in EtOH Flow Rate (mL/min) | Syringe 2 0.28 N $Li_2S$ in EtOH Flow Rate (mL/min) | Total EtOH (vppm) | Gasoline Flow Rate (mL/min) | S:KOH:$Li_2S$ (Molar) | Avg. Product S (mg/L) |
|---|---|---|---|---|---|
| 0.03 | 0.12 | 3,000 | 50 | 1:0.9:0.57 | 0 |
| 0.03 | 0.24 | 2,700 | 100 | 1:0.45:0.57 | 5 |
| 0.03 | 0.12 | 1,500 | 100 | 1:0.45:0.29 | 11 |

What is claimed is:

1. A process for reducing the elemental sulfur content of a fluid containing same, comprising contacting said fluid with (a) an inorganic caustic material, (b) an alcohol and (c) an organo mercaptan, sulfide or mixtures thereof in amounts effective to form a fluid insoluble polysulfide salt and separating the fluid insoluble components from the fluid.

2. The process of claim 1 wherein said inorganic caustic material is NaOH, KOH or mixtures thereof.

3. The process of claim 2 wherein the organo mercaptan is an alkyl mercaptan containing 2 to 5 carbon atoms and the alcohol contains 1 to 4 carbon atoms.

4. The process of claim 3 wherein the fluid is a refined petroleum fuel which has been transported through a pipeline used to transport a sour hydrocarbon stream.

5. The process of claim 4 wherein the fuel is gasoline containing from about 10 to about 60 mg elemental sulfur per liter.

6. A process for reducing the corrosivity of a hydrocarbon fuel by removing elemental sulfur resulting from the transportation of said fuel through a pipeline used to transport a sour hydrocarbon stream, which process comprises contacting said fuel with inorganic caustic, an alcohol and an organo mercaptan in amounts to form a fuel insoluble polysulfide salt, separating the fuel insoluble components from the fuel, and recovering a fuel of reduced corrosivity.

7. The process of claim 6 wherein said inorganic caustic is NaOH, KOH and mixtures thereof.

8. The process of claim 7 wherein the organo mercaptan is an alkyl mercaptan containing 2 to 5 carbon atoms and the alcohol contains 1 to 4 carbon atoms.

9. The process of claim 8 wherein the inorganic caustic is NaOH, the alcohol is ethanol and the mercaptan is methyl, ethyl or n-propyl mercaptan.

10. The process of claim 6 comprising recovering a treated fuel having an elemental sulfur level of 3 mg/L or lower.

* * * * *